United States Patent [19]

Campbell

[11] 4,095,749

[45] Jun. 20, 1978

[54] NOZZLE

[76] Inventor: Duncan Paul Campbell, 55 Sinclair Ave., Unit 6, Georgetown, Ontario, Canada, L7G 4S4

[21] Appl. No.: 789,214

[22] Filed: Apr. 20, 1977

Related U.S. Application Data

[62] Division of Ser. No. 656,403, Feb. 9, 1976, Pat. No. 4,044,954.

[51] Int. Cl.[2] ..... B05B 1/32

[52] U.S. Cl. ..... 239/458; 151/14 R; 239/460

[58] Field of Search ..... 239/456, 460, 458; 151/14 R, 22; 220/290, 288, 289

[56] References Cited

U.S. PATENT DOCUMENTS

| | | | |
|---|---|---|---|
| 2,612,285 | 9/1952 | Benson | 220/288 |
| 2,816,800 | 12/1957 | Russell | 239/460 X |
| 2,991,016 | 7/1961 | Allenbaugh, Jr. | 239/458 |
| 3,435,978 | 4/1969 | Wittwer | 151/14 R X |

*Primary Examiner*—Richard A. Bertsch
*Assistant Examiner*—Michael Mar
*Attorney, Agent, or Firm*—James Tate Wilbur

[57] ABSTRACT

The nozzle includes a sleeve and a hollow body concentrically disposed within the sleeve. A hollow cylindrical baffle housing is coaxially maintained within the body by vanes which extend between the housing outer wall and the body inner wall. Formed on the outer wall of the body is a thread which mates with a thread on the inner wall of the sleeve to permit rotation of the sleeve relative to the body between two stop positions. A baffle is secured to the baffle housing and is provided with a head which, as the sleeve is rotated toward the first stop position, approaches a baffle seat formed on the sleeve and thereby diminishes the quantity of liquid discharging from the nozzle. The sleeve is prevented from being rotated beyond the second stop position by two alternative modes: the female thread at its trailing edge is provided with an end wall which is disposed normal to the adjacent side walls of the thread and which, when the leading edge of the male thread is advanced into contact therewith prevents further advance of the male thread. Alternatively, the trailing edge of the male thread is provided with an enlarged portion which jams in the female thread when the sleeve is in the second stop position and prevents further rotation of the sleeve.

4 Claims, 6 Drawing Figures

NOZZLE

This application is a division of Ser. No. 656,403, filed Feb. 9, 1976, now U.S. Pat. No. 4,044,954.

This invention relates to nozzles and particularly to nozzles which are readily rotatable from a fully open to a closed position and which are adapted to be mounted upon the ends of conduits.

Nozzles intended for use in fighting fires usually provide means for selectively discharging the water as a solid straight stream or as a finely dispersed spray or fog. Usually the nozzles include a sleeve within which a hollow cylindrical body member is concentrically disposed. The body member is provided with male threads on its outer wall which mate with female threads provided on the inner wall of the sleeve so that rotation of the sleeve relative to the body member results in relative longitudinal movement of the two members. A baffle is fixed in position centrally of the body and is provided with a head which cooperates with a ring-like baffle seat provided at or near the outlet end of the sleeve to form an annular outlet through which water flowing through the nozzle may discharge.

Rotation of the sleeve of the nozzle relative to the body member results in longitudinal displacement of the sleeve relative to the body member with like displacement of the baffle head, which is secured to the body member, relative to the baffle seat. It is this latter displacement which alters the form of the water which discharges from the nozzle from a solid straight stream to a finely dispersed spray or fog.

Problems are frequently encountered in operating such nozzles. To prevent the sleeve from being overtightened on the body member, the body member is provided with stop means which contact stop engagement means on the sleeve when the nozzle is in the fully open position. The stop means serves to prevent further rotation of the sleeve in a valve opening direction. Usually the stop means comprises a shoulder formed on the body member which, when the nozzle is in its fully open position, contacts an end wall of the sleeve. However, a large force is required to rotate the sleeve from the fully open position toward the closed position. This is chiefly because of the friction between the end wall of the sleeve and the shoulder. Since there is a relatively large area of contact between the sleeve end wall and the shoulder, the frictional force which inhibits rotation of the sleeve from the fully open position is considerable.

Another problem with many known fire nozzles is the difficulty of modifying their structures according to the desired shape of the stream of water which discharges from them. If it were possible to modify the outlet ends of the nozzles to increase their angle relative to the longitudinal axis of the sleeve, the angle of discharge would likewise be increased. However, the outlet ends are usually provided with a plurality of beads for forming water into a fog pattern and if a portion of the material which forms the outlet were trimmed off to increase the angle of the outlet, these beads would be removed. Once the beads were removed, the fog-forming capability of the nozzle would be lost.

It is an object of this invention to provide a nozzle which may be readily rotated from the fully open position toward the closed position. When the nozzle is in the fully open position, the end wall of the sleeve is spaced apart from the shoulder of the head and no resistance to rotation of the sleeve is offered by friction between the sleeve end wall and the shoulder.

It is another object of this invention to provide a nozzle in which the angle of the discharge end may be increased without rendering the nozzle incapable of forming water which discharges therefrom into a fog.

The nozzle of the invention may be broadly described as comprising a hollow body; a sleeve disposed about said body and having a thread formed on its inner wall which mates with a thread formed on the outer wall of said body to permit rotation of said sleeve relative to said body between first and second stop positions; a baffle secured to said body and having a head which, as the sleeve is rotated toward the first stop position, approaches a baffle seat formed on said sleeve and thereby diminishes the quantity of liquid discharging from said nozzle; and stop means integral with the thread of one of said sleeve and said body and abutting against the other said thread when said sleeve is rotated to the second stop position to prevent further rotation of said sleeve in the same direction.

The invention is explained with reference to the accompanying drawings showing preferred embodiments of the nozzle. In the drawings.

Like reference characters refer to like parts throughout the description of the drawings.

Figure 1:
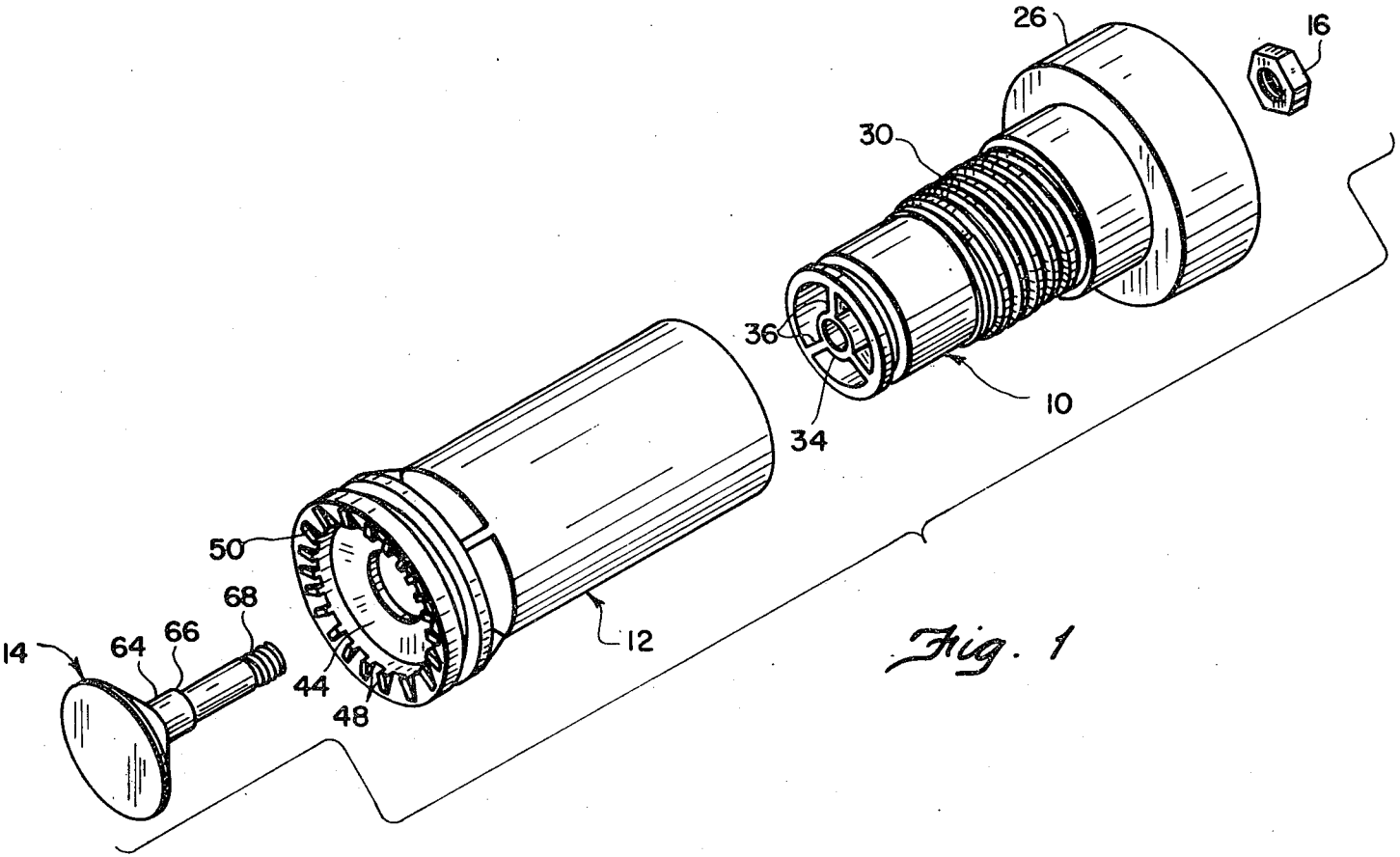
FIG. 1 is an exploded perspective view of the components which make up the nozzle of the subject invention.

With reference to the drawings, the nozzle of the invention comprises a hollow cylindrical body member generally indicated by the numeral 10, a hollow cylindrical sleeve 12 and a baffle 14 secured within the nozzle by a baffle nut 16. Body 10 has an inner wall 18, an outer wall 20, an outlet end 22 and an inlet end 24. At the inlet end 24 of the body there is provided a shoulder 26 having female threads 28 on its inner wall for securing the body to a male threaded hose fitting (not shown). Adjacent the outlet end on the outer body wall 20, an annular groove 29 is formed for accommodation of an 0-ring to prevent liquid in the nozzle from leaking through the space between the body and the sleeve. Also on the outer body wall, there is provided male threads 30 which commence at a leading or downstream end 31 and extend helically upstream to a trailing or upstream end 32. The latter end is integral with a cross-axially extending wall 33.

A hollow cylindrical baffle housing 34 is coaxially maintained with body 10 by vanes 36. Preferably only three vanes are provided, they being disposed equidistantly about the baffle housing and extending radially between the outer wall 38 of the housing and the inner wall 18 of the body. The baffle housing is relatively elongated and the vanes which extend the length of the housing are likewise relatively elongated, being not less than about ⅓ of the total length of the body between the outlet and inlet ends 22, 24.

Figure 4:
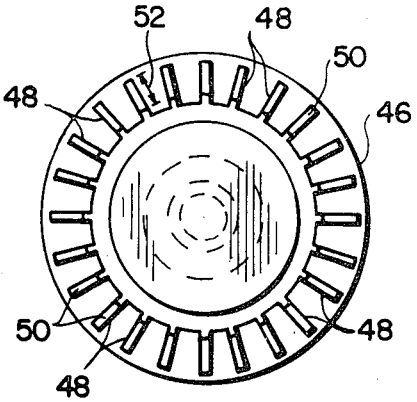
FIG. 4 is an elevation of the discharge end of the nozzle.

Sleeve 12 has inlet and outlet ends 40,42 respectively and an annular baffle or valve seat 44 of reduced diameter is formed adjacent the latter end. The baffle seat is disposed at an oblique angle relative to the longitudinal axis of the sleeve and preferably the diameter of the seat at its upstream edge 44*a* is at least about 30% of the inside diameter of the sleeve. Stepped outwardly from the baffle seat and disposed at the outlet end 42 of the sleeve is an annual end wall 46 which is also inclined at an oblique angle relative to the longitudinal axis of the sleeve. With reference to FIG. 4, a plurality of teeth 48 are spaced circumferentially about the end wall 46 and project outwardly thereof. The upper surface 50 of each tooth lies in a plane which is disposed normal to the longitudinal axis of the sleeve and the length of each tooth, marked 52 and measured on a line which extends radially from the axis of the sleeve and which lies on the previously-mentioned plane, is at least 10% of the length of the radius of the sleeve at the outlet end 42. Because of the length of the teeth the angle of the outlet end of the sleeve can be increased without removing the teeth entirely. For example, if the circular edge disposed radially inward of line 53 is removed, the angle of discharge of liquid from the nozzle is increased yet the fog forming capability of the nozzle is not impaired since a portion of the teeth still remains.

Figure 2:
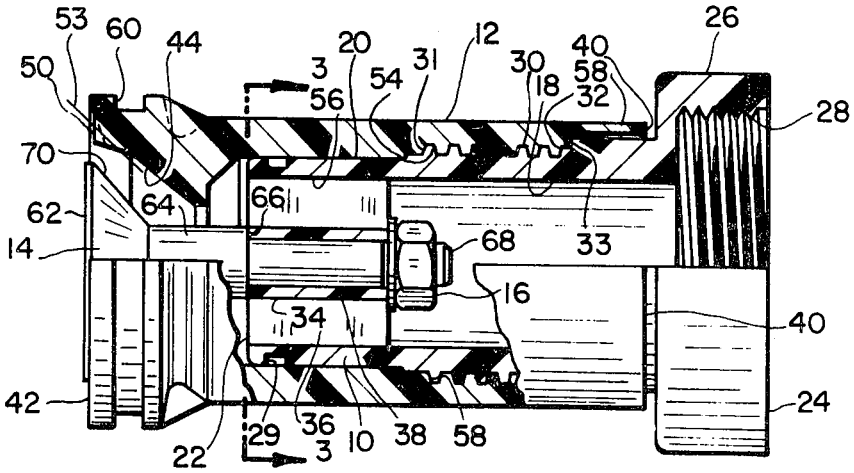
FIG. 2 is a side elevation, partly in section, of the components of the nozzle in an assembled state.
Figure 5:
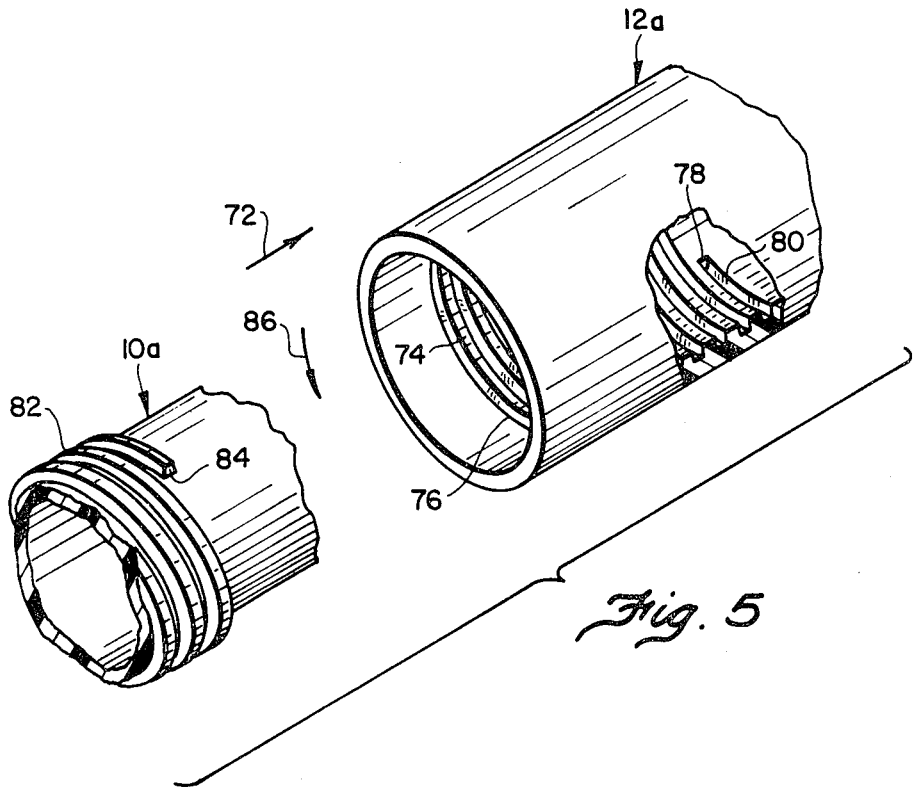
FIG. 5 is an exploded perspective view, partially cut away, of two of the components of the nozzle.

A female thread 54 is formed on the inner wall 56 of the sleeve. The thread commences at a leading or upstream end 56, extends helically downstream and terminates at a trailing or downstream end 58. The leading or trailing ends of the thread are spaced apart from the sleeve inlet and outlet ends 40,42 respectively. As illustrated in FIGS. 2 and 5, the female thread has a uniform cross-section throughout its extent between its two ends.

An annular groove 60 is formed on the outer wall of the sleeve adjacent its outlet end. The groove is provided to accomodate a rubber or polymeric bumper (not illustrated) for protection of the sleeve when the nozzle is in use.

Baffle 14 consists of a circular head 62 and a stem 64 which is stepped inwardly at 66 and is provided with threads 68 at its end for attachment of baffle nut 16. The undersurface 70 of the head is inclined at substantially the same angle relative to the longitudinal axis of the stem as the baffle seat 44 relative to the longitudinal axis of the sleeve. Thus when the baffle is secured for use in the baffle housing 34 as illustrated in FIG. 2, rotation of the sleeve relative to the body in a downstream direction causes the undersurface 70 of the baffle head to come into contact with baffle seat 44. Contact between the undersurface and the baffle seat is along substantially their entire lengths so that all liquid within the nozzle is positively prevented from discharging through the outlet end of the sleeve. When the sleeve is in such position, the sleeve is in a downstream or first stop position since no further downstream rotation of the sleeve is possible.

Figure 3:
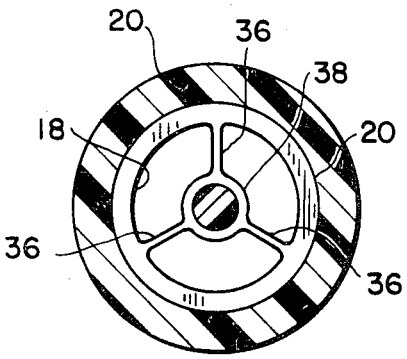
FIG. 3 is a section on line 3-3 of FIG. 2.
Figure 6:
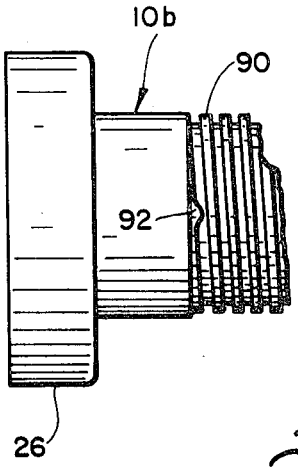
FIG. 6 is an elevation of a portion of one of the nozzle components.

FIG. 5 illustrates the means by which rotation of the sleeve on the body in an upstream direction is halted when the sleeve reaches an upstream or second stop position and FIG. 6 illustrates another means for doing so. With reference first to FIG. 5, the positions of sleeve 12*a* and 10*a* are reversed from that shown in FIGS. 2 and 3 and the flow of liquid therethrough is also reversed being in the direction of arrow 72. The female thread 74 is formed in the inside wall of the sleeve commences at a leading or upstream end 76 and extends helically downstream of the flow of liquid through the nozzle and terminates at a wall 78 at its trailing or downstream end. The latter wall is disposed generally normal to the side walls 80 of the thread adjacent thereto.

The male thread 82 extends helically across the outer wall of the body between its leading or upstream end and its trailing or downstream end 84. As illustrated in FIGS. 2, 5 and 6, the male thread has a uniform cross-section throughout its extent between its two ends. Rotation of the sleeve in an upstream direction in the direction of arrow 86 causes the end wall 78 of the female thread to approach and eventually contact the downstream end 84 of the male thread. When contact is made, the sleeve is in an upstream or second stop position since no further upstream rotation of the sleeve is possible.

In the embodiment illustrated in FIG. 5 and just described, the end wall 78 of the female thread acts as a stop means which coacts with the downstream end of the male thread to prevent upstream rotation of the sleeve. In the embodiment illustrated in FIG. 6 by contrast, the stop means is integral with the male thread and coacts with the female thread to prevent further upstream rotation. In the latter embodiment, head 10*b* is provided with a male thread 90 having an enlarged portion 92 at its trailing or upstream end. The enlarged portion may be formed by milling the trailing end of the thread where the nozzle is formed of metal or, where the nozzle is formed of molded polymeric material, it may be formed by hollowing the mold slightly at the thread end. Rotation of the sleeve on the head in an upstream direction causes the leading edge of the female thread of the sleeve to approach and eventually contact the enlarged portion 92. Further upstream rotation is prevented by the enlarged portion which jams or binds in the female thread. When the female thread contacts the enlarged portion, the sleeve is at the upstream or second stop position.

The fire hose nozzle of the invention is assembled by first turning sleeve 12 unto body 10 to cause mating of male threads 30 with female threads 54. The stem 64 of baffle 14 is then inserted through the circular opening defined by baffle seat 44 and into baffle housing 34 and is secured to the housing by rotating baffle nut 16 on the threaded stem end 68 until surface 66 of the stem is firmly in contact with the wall of the baffle housing at the outlet end 22 of the head. Rotation of the sleeve on the head in an upstream direction results in movement of the end wall 78 of the female thread of the sleeve towards and into contact with the downstream end of the male thread as in the embodiment illustrated in FIG. 5 or of movement of the female leading edge of the sleeve towards and into contact with the enlarged portion 92 of the male thread as in the embodiment illustrated in FIG. 6. The nozzle is then in the position illustrated in FIG. 2 and the outlet end 40 of the sleeve is spaced apart from shoulder 26. In such position, the spacing between the baffle head 62 and the baffle seat 44 is at its maximum extent and the maximum quantity of liquid discharges from the nozzle.

Rotation of the sleeve in the opposite direction results in movement of the baffle seat toward the undersurface 70 of the baffle head with resulting attenuation in the quantity of liquid flowing through the valve. When the baffle head and the baffle seat contact each other, the flow of liquid through the nozzle is fully shut off.

It will be understood of course that modifications can be made in the preferred embodiment of the nozzle described and illustrated herein without departing from the scope and purview of the invention. For example, the positions of the male and female threads may be reversed so that the male thread is formed on the inner wall of the sleeve and the female thread is formed on the outer wall of the head. In such event of course the stop means illustrated in FIG. 5 will be formed on the head and the stop means illustrated in FIG. 6 will be formed on the sleeve.

What I claim as new and desire to protect by Letters Patent of the United States is:

1. A nozzle comprising a hollow body; a sleeve disposed about said body and having a baffle seat, one of said sleeve and said body having a female thread formed in its inner and outer wall respectively for mating with a male thread formed on the respective inner and outer wall of the other of said sleeve and body to permit rotation of said sleeve relative to said body between upstream and downstream stop positions, said male thread having at its trailing portion an enlarged member which contacts the leading portion of the female thread when said sleeve is at the upstream stop position and thereby prevents further upstream rotation of said sleeve; and a baffle secured to said body and having a head, which as the sleeve is rotated toward the downstream stop position, approaches said baffle seat and thereby diminishes the quantity of liquid discharging from said nozzle.

2. The nozzle as claimed in claim 1 wherein said baffle is secured to said body by means of a hollow cylindrical baffle housing coaxially maintained within said body by three only vanes disposed equidistantly about said housing and extending radially between the outer wall of said housing and the inner wall of said body.

3. The nozzle as claimed in claim 2 wherein the length of each said vane is not less than about $\frac{1}{3}$ of the total length of said body.

4. The nozzle as claimed in claim 1 wherein said sleeve is provided at its outlet end with an annular wall from which extend a plurality of spaced radially disposed teeth each having a length measured on a line which extends radially and normally from the longitudinal axis of said sleeve, which length is at least 10% of the length of the radius of the outer circumference of said annular wall.

* * * * *